US009145879B2

(12) United States Patent
Pirovano et al.

(10) Patent No.: US 9,145,879 B2
(45) Date of Patent: Sep. 29, 2015

(54) ACOUSTIC FILTER SUITABLE FOR RECIPROCATING COMPRESSOR

(71) Applicant: WHIRLPOOL S.A., São Paulo-SP (BR)

(72) Inventors: Moacir Pirovano, Joinville (BR); Emerson Moreira, Joinville (BR); Tadeu Tonheiro Rodrigues, Joinville (BR); José Nilton Fonseca Junior, Joinville (BR)

(73) Assignee: Whirlpool S.A., Sao Paulo, SP (BR)

( * ) Notice: Subject to any disclaimer, the term of this patent is extended or adjusted under 35 U.S.C. 154(b) by 0 days.

(21) Appl. No.: 14/365,380

(22) PCT Filed: Nov. 8, 2012

(86) PCT No.: PCT/BR2012/000435

§ 371 (c)(1),
(2) Date: Jun. 13, 2014

(87) PCT Pub. No.: WO2013/086592

PCT Pub. Date: Jun. 20, 2013

(65) Prior Publication Data

US 2014/0345968 A1 Nov. 27, 2014

(30) Foreign Application Priority Data

Dec. 15, 2011 (BR) ..... 1105162

(51) Int. Cl.
*F02K 1/82* (2006.01)
*F04B 39/00* (2006.01)
*F04B 39/12* (2006.01)

(52) U.S. Cl.
CPC ..... *F04B 39/0061* (2013.01); *F04B 39/0055* (2013.01); *F04B 39/123* (2013.01)

(58) Field of Classification Search
CPC ..... F02K 1/827; F02K 1/00
USPC ..... 181/212, 213, 214
See application file for complete search history.

(56) References Cited

U.S. PATENT DOCUMENTS

| | | | | |
|---|---|---|---|---|
| 6,524,080 | B1 * | 2/2003 | Chintamani et al. | 417/312 |
| 6,845,843 | B2 * | 1/2005 | Svendsen et al. | 181/262 |
| 7,922,460 | B2 * | 4/2011 | Nagao et al. | 417/312 |
| 8,584,795 | B1 * | 11/2013 | Buckner | 181/224 |
| 2013/0020146 | A1 * | 1/2013 | Pawelski et al. | 181/212 |

FOREIGN PATENT DOCUMENTS

| | | | |
|---|---|---|---|
| WO | 9743547 | A1 | 11/1997 |
| WO | 02101239 | A1 | 12/2002 |

(Continued)

OTHER PUBLICATIONS

International Search Report issued by the European Patent Office in PCT/BR2012/00435, dated Feb. 22, 2013, 4 pages.

*Primary Examiner* — Forrest M Phillips
(74) *Attorney, Agent, or Firm* — Brian J. Colandreo; Jeffrey T. Placker; Holland & Knight LLP

(57) ABSTRACT

The present invention refers to an acoustic filter for reciprocating compressor and, in special, a suction acoustic filter containing at least one inlet pipeline (21), at least one outlet pipeline (22), and at least one intermediate pipeline (42). Said acoustic filter (1) comprises at least two horizontal chambers (5, 6), wherein said chambers are interconnected by an intermediate pipeline (42), which has a superior portion (421) with a length that is equivalent to approximately 75% to 98% of the height of the first horizontal chamber (5) and an inferior portion (422) with a length that is equivalent to approximately 45% to 80% of the height of the second horizontal chamber (6).

6 Claims, 3 Drawing Sheets

(56) References Cited

FOREIGN PATENT DOCUMENTS

| | | | | | |
|---|---|---|---|---|---|
| WO | 2005019645 | A1 | | 3/2005 | |
| WO | 2006030559 | A1 | | 3/2006 | |
| WO | 2008098330 | A2 | | 8/2008 | |
| WO | WO 2008098330 | A2 | * | 8/2008 | ..... F04B 39/00 |

* cited by examiner

ACOUSTIC FILTER SUITABLE FOR RECIPROCATING COMPRESSOR

RELATED APPLICATIONS

The subject application is a U.S. National Stage Application of International Application No. PCT/BR2012/000435, filed on Nov. 8, 2012, which claims the priority of Brazil Patent Application No.: PI1105162-0, filed on Dec. 15, 2011, the contents of which are herein incorporated by reference in its entirety.

FIELD OF THE INVENTION

The present invention refers to an acoustic filter for reciprocating compressor and, in special, a suction acoustic filter that is provided with means of retaining the noise and means of retaining the liquid-phase fluid.

BACKGROUND OF THE INVENTION

The current prior art is composed of an infinity of models of suction acoustic filters for reciprocating compressors. Generally, such suction filters comprise a chamber arranged between the fluid return pipeline of any system (such as, for example, a refrigeration system) and the suction inlet of the reciprocating compressor that composes that system.

As already known by the skilled in the art, the main functionality of these types of suction acoustic filters is the mitigation of part of the suction noise caused by the compressor. Thus, the chamber of the suction acoustic filters presents a volume that is capable of muffling the suction pulsations.

Consequently, it is noted that the volume of the chamber of a suction acoustic filter must be, in a certain way, pre-sized in accordance with the capability and applicability of each reciprocating compressor. In this sense, it is also considered the type of working fluid that will be compressed. Moreover, it is broadly known that the prior art provides several types of materials for manufacturing suction acoustic filters.

Conventionally, the suction acoustic filter suitable for reciprocating compressor is placed in the interior of the shell of the compressor, the inlet thereof being immediately next to the fluid return pipeline, and the outlet thereof being physically associated with the head of the compressor. Therefore, the chamber of the suction acoustic filter shall present a volume that is suitable for its operation, and, additionally, it cannot occupy a big area in the interior of the shell of the compressor.

A great part of the prior art suction acoustic filters is exclusively designed for reducing noises, and, in this case, other arrangements, that are incorporated or not into the compressor, are responsible for eliminating liquid fluids from the inlet of the suction of the compressor.

Thus, it shall be emphasized that the entrance of liquid-phase fluids in the suction chamber of the compressor extremely prejudices its operation, since liquids are not compressible. The compression of liquids results in very high pressure levels, which can cause the failure in the components of the compressor, reducing, therefore, the performance and the service life or, in a more extreme case, causing the critical failure in the compressor with total loss of operation.

Causes for the return of liquid to the compressor are assorted, and the major causes are related to failures in the design or in the use of the refrigeration system. Peculiarly, in refrigeration systems of commercial use, it is necessary to have a robust compressor to deal with the return of critical amounts of fluid, more specifically in two processes: flooded start and thaw of the evaporator (in refrigeration systems). In the flooded start, the compressor has its shell partially filled with the working fluid in the liquid phase, and the process of starting shall occur considering such severity. In the thaw of the evaporator, occurs the continuous pumping of the liquid to the compressor, due to the use of the overheated gas of the discharge of the compressor to thaw the evaporator, wherein the gas is liquefied and returns through the suction.

One example of the arrangement (placed outside from the suction acoustic filter) designed for reducing the liquid-phase fluid can be observed in document PCT/BR2010/000179, wherein it is revealed a suction pipeline whose inlet end for the fluid return presents a geometry that is capable of expelling part of the liquid-phase fluid.

In any case, the current prior art also provides suction acoustic filters whose constructivity is, in part, responsible for the retention of at least one portion of the working fluid in the liquid phase.

One example of this type of acoustic filter can be noted in document U.S. Pat. No. 6,547,032. The object of this document is further illustrated, for better clarifications, in FIG. 1 of the instant invention.

The filter illustrated in FIG. 1 (figure of document U.S. Pat. No. 6,547,032, but having the references altered) comprises a chamber that, among other aspects, comprises one inlet E, one outlet S, and one intermediate pipeline I. Thus, all the return fluid (suction fluid), whether in the liquid phase or in the gaseous phase, enters the acoustic filter through the inlet E, flows towards the bottom of the chamber through the intermediate pipeline I, and flows towards the outlet pipeline S. As the intermediate pipeline I is not interconnected to the outlet pipeline S, it can be considered that at least one portion of the liquid-phase fluid will be retained in the bottom of the chamber of the acoustic filter. However, this aspect is not mentioned in document U.S. Pat. No. 6,547,032, and, moreover, it is noted that, since the liquid-phase fluid occupies a certain volume of the chamber, the function of retaining liquids is almost non-existent.

Additionally, the inlet E of the acoustic filter of FIG. 1 (document U.S. Pat. No. 6,547,032) is inferior, resulting in the suction of a greater amount of liquid-phase fluid by the acoustic filter, since the inlet E is directed to the inferior region of the shell of the compressor which is conventionally filled with working fluid in the liquid phase.

In this sense, it shall be further mentioned that the current prior art already reveals models of suction acoustic filters whose inlet and outlet are directed to the superior region of the shell of the compressor, whose purpose is to deal with the flooded start process, capturing the gas above the liquid portion. One example of such assemblage is illustrated in FIG. 2 of the instant invention.

Although the above-mentioned solutions are robust against processes considering the suction of liquids, there is a decrease of the efficiency of the compressor during its normal operation. The gas that enters the suction passing part is not directly conducted to the inlet of the acoustic filter. Before reaching the inlet of the suction chamber, the gas gets in contact with the hot parts of the compressor, causing the heating and reduction of its specific mass, resulting in the decrease of mass flow, capability of refrigeration and performance. One solution to reduce the effects of the overheating, without losing its robustness against the suction of liquids, would be the generation of obstacles for the suction of liquids without prejudicing the suction of gas.

Thus, it is noted that the current solutions and designs of suction acoustic filters for reciprocating compressors do not provide concretizations that are especially dedicated to efficiently retain the working fluid in the liquid phase, and, with basis on this scenario, the present invention will be defined.

OBJECTIVES OF THE INVENTION

Thus, one of the objectives of the present invention is the provision of a suction acoustic filter that is particularly composed of means for retaining noises and means of retaining the liquid-phase fluid, which occurs in compressors of commercial application during the above-mentioned processes.

In this sense, it is also one of the objectives of the present invention the provision of a suction acoustic filter containing at least two levels for retaining the liquid-phase fluid.

Still another objective of the present invention is the provision of means for retaining the liquid-phase fluid in the suction acoustic filter without prejudicing the flow of the fluid that is in the gaseous phase. It is also one objective of the present invention the reduction of the negative effects of overheating and loss of performance, which occurs in the prior art.

SUMMARY OF THE INVENTION

These and other objectives of the instantly revealed invention are totally achieved by the acoustic filter suitable for reciprocating compressor, which comprises a suction acoustic filter.

The instantly revealed suction acoustic filter comprises at least one inlet pipeline, at least one outlet pipeline, and at least one intermediate pipeline. Moreover, said suction acoustic filter further comprises at least two horizontal chambers, wherein at least one intermediate pipeline has a superior portion (421) with a length that is equivalent to approximately 75% to 98% of the height of the first horizontal chamber (5). Preferably, said intermediate pipeline further has an inferior portion with a length that is equivalent to approximately 45% to 80% of the height of the second horizontal chamber.

Preferably, the suction acoustic filter is composed of a superior body, an inferior body, and at least one internal body, wherein the intermediate pipeline is defined in the internal body. It shall be further mentioned that the horizontal chambers are delimited by the internal body.

Also preferably, the inlet pipeline has a fundamentally oblong or circular perimeter, and at least one inlet shield that is defined by the angled displacement between the vertical edge and a plane which orthogonally cuts the outlet pipeline which is arranged at a forty-five degree angle.

SHORT DESCRIPTION OF THE DRAWINGS

Figures described below illustrate:

DETAILED DESCRIPTION OF THE INVENTION

Figure 1:
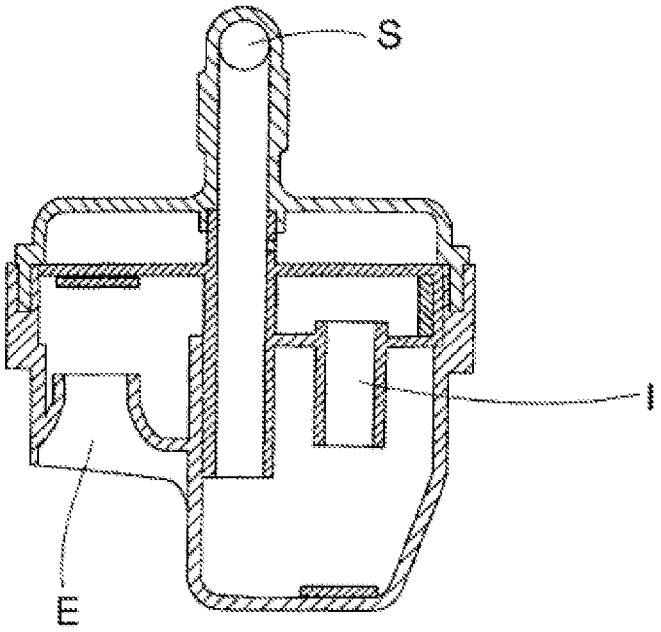
Fig. 1 Prior Art
FIGS. 1 and 2 illustrate the design of the current prior art suction acoustic filters.
Figure 2:
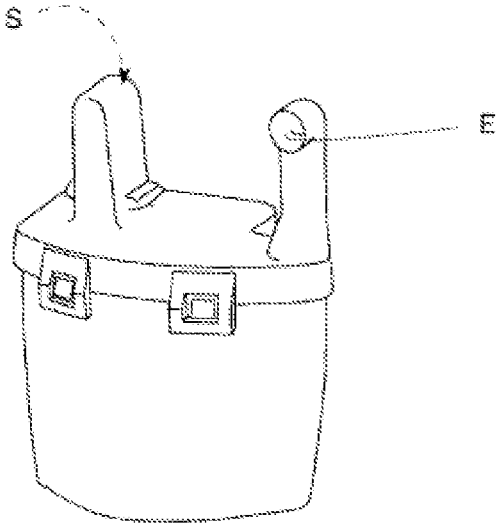
Fig. 2 Prior Art
Figure 3:
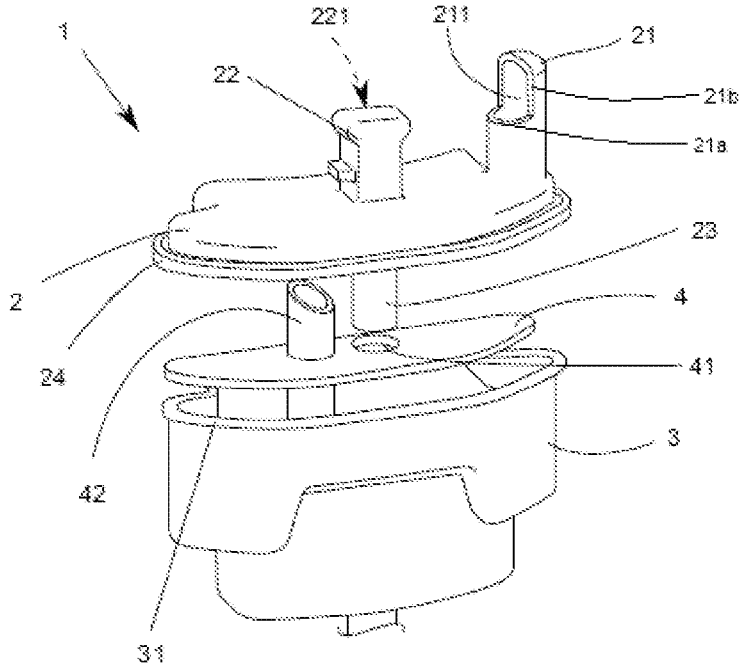
FIG. 3 illustrates an exploded perspective view of the suction acoustic filter of the present invention.
Figure 4:
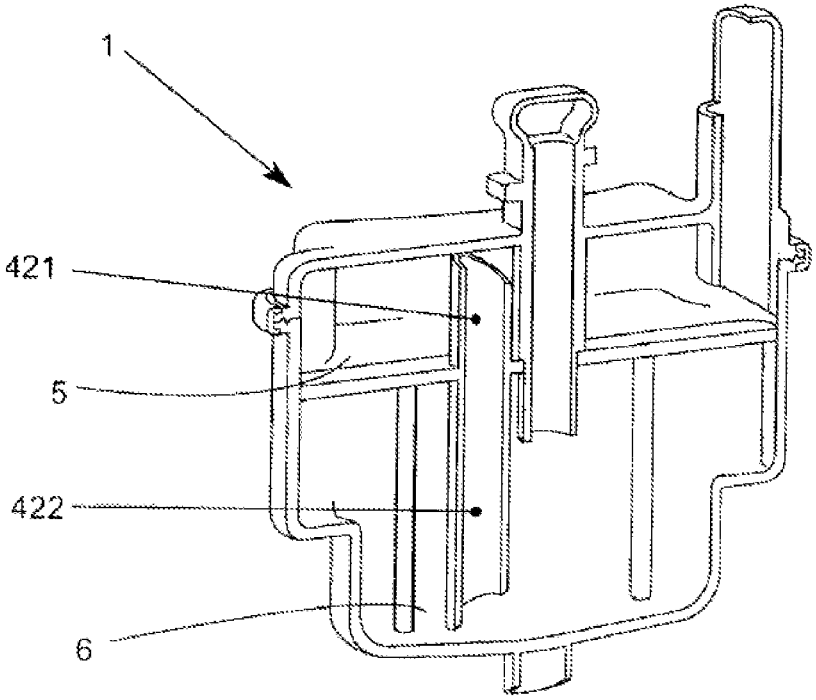
FIG. 4 illustrates a cut view of the suction acoustic filter of the present invention.
Figure 5:
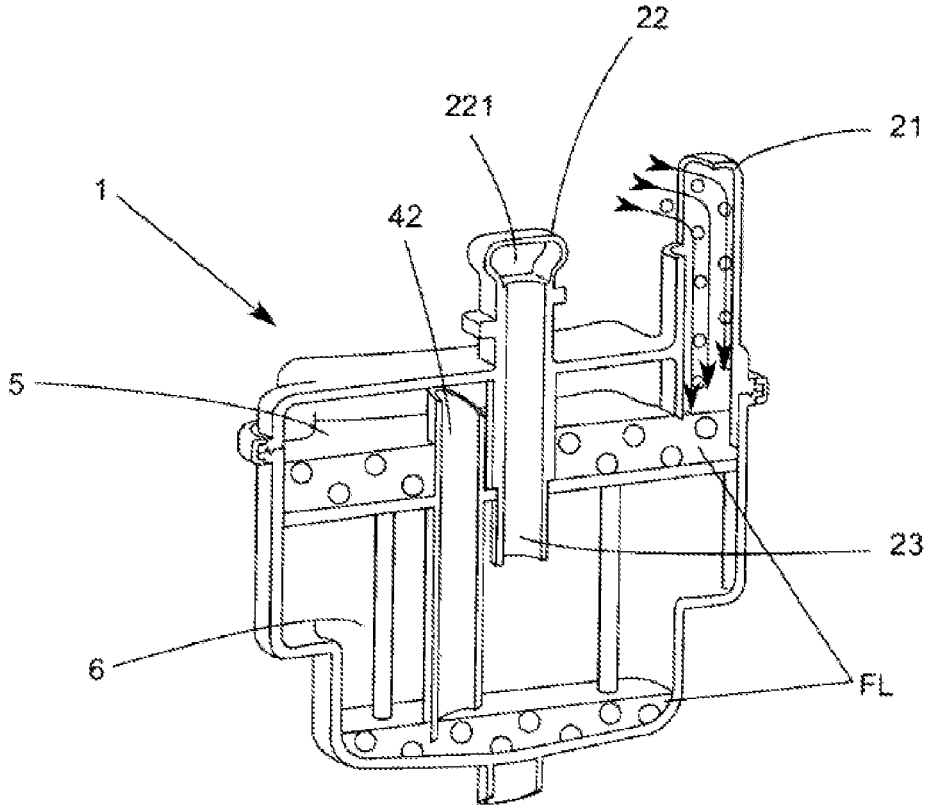
FIG. 5 illustrates a functional exemplification of the suction acoustic filter of the present invention.

According to the concepts and objectives of the present invention, it is revealed a suction acoustic filter (or suction muffler) composed of (conventional) means of retaining noises and (unpublished) means of retaining the liquid-phase fluid.

According to the preferred embodiment of the present invention—illustrates in FIGS. 3, 4, 5, and 6—it is provided an acoustic filter 1 composed of a superior body 2 and an inferior body 3.

Said superior body 2 comprises the cap of the acoustic filter 1, and it comprises an inlet pipeline 21, an outlet pipeline 22, and a sealing edge 24.

The inlet pipeline 21 is a snorkel-type pipeline (an extended pipeline and fundamentally aligned with the suction pipeline TS of the compressor). According to the instantly proposed design, the inlet pipeline 21 has a fundamentally oblong profile and an inlet shield 211 defined at 45° defined by the angled displacement ($\alpha$) between the vertical edge (21*b*) and a plane which orthogonally cuts the outlet pipeline (21).

The outlet pipeline 22 is a pipeline presenting a fundamentally cylindrical profile. The external end of such pipeline has a posterior outlet shield 221, and its internal end 23 extends up to the half-height of the acoustic filter 1.

Generally, the superior body 2 is a solid body with a fundamentally elliptical perimeter; consequently, its sealing edge 24 has also a fundamentally elliptical boundary.

The inferior body 3 is a body whose volume is defined so as to shape it into the acoustic filter. The geometrical shape of the inferior body 3, as well as its means of sound attenuation, is already known by the skilled in the art. Thus, the inferior body 3 has a boundary edge 31 responsible for sealing the acoustic filter 1 (when properly assembled).

The acoustic filter 1 further includes an internal body 4, which comprises a plate of analogous perimeter in relation to the perimeter of the superior body 1.

Said internal body 4 has a passing hole 41 and an intermediate pipeline 42, which is superiorly and inferiorly projected. It shall be emphasized that the cited intermediate pipeline 42 has a superior portion 421 with a length that is equivalent to approximately 75% to 98% of the height of the first horizontal chamber 5 and an inferior portion 422 with a length that is equivalent to approximately 45% to 80% of the height of the second horizontal chamber 6.

According to the coherent assemblage of the superior body 2, inferior body 3, and internal body 4, it is noted that the interior of the acoustic filter 1 causes the definition of two horizontal chambers 5 and 6, which are interconnected by the intermediated pipeline 42.

Moreover, it is noted that the inlet pipeline 21 of the superior body 2 connects the external part of the acoustic filter 1 to the first horizontal chamber 5. On the other hand, the outlet pipeline 22 of the superior body connects the second horizontal chamber 6 to the compression chamber (not illustrated) of the compressor (not illustrated).

The first horizontal chamber 5 actuates as a reservoir for the excess of liquid fluid FL that enters the inlet pipeline 21. The passage of liquid to the second horizontal chamber 6 is blocked by the configuration of the intermediate pipeline 42 which captures the gas in the top of the first horizontal chamber 5, functioning as a second connection pipe for the second horizontal chamber 6.

The eventual excess of liquid stored in the first horizontal chamber 5 naturally evaporates during the normal operational cycle of the compressor due to the pressure drop caused by the suction process. Due to safety reasons, the second horizontal chamber 6 presents a considerable volume and has an internal end 23 which leads the gas to the suction chamber at a significant height of the bottom of the chamber.

Figure 6:
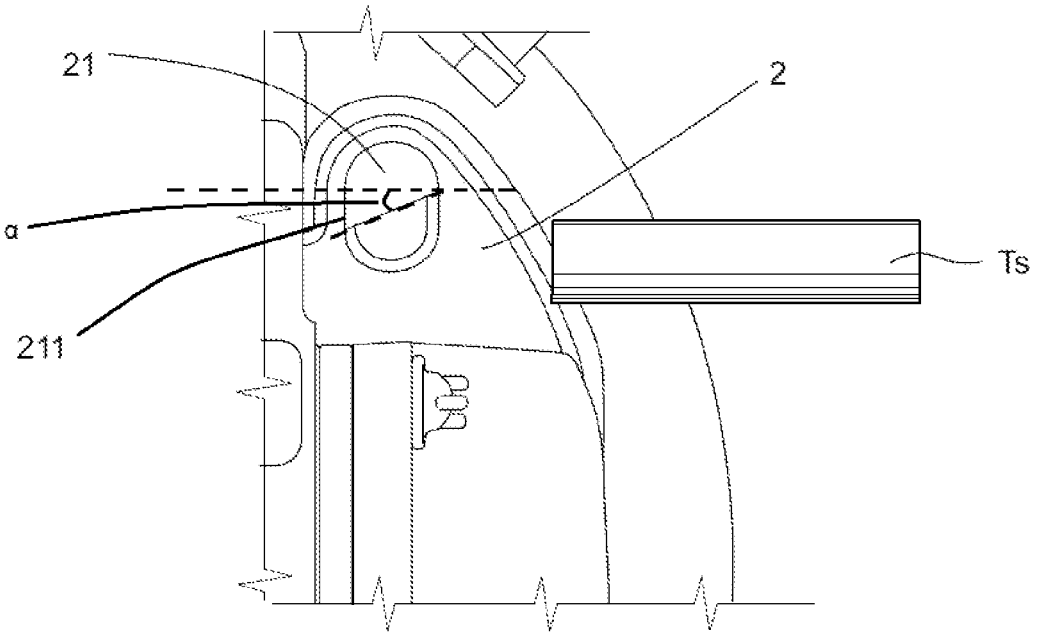
FIG. 6 illustrates an extended detailed of the preferred positioning of the suction acoustic filter of the present invention, in relation to the suction pipeline of a reciprocating compressor.

The internal arrangement of the horizontal chambers 5 and 6 is optimized in conjunction with the proposed positioning, between the suction pipeline TS and the inlet pipeline 21. This "misaligned" positioning—as illustrated in FIG. 6—is especially relevant in eventual systems wherein the amount of liquid-phase fluid is considerable. This occurs due to the fact that this "misaligned" reduces, in a controlled manner, the admission of liquids in the interior of the acoustic filter 1. The benefit of such solution is observed during the standard operation of the compressor, wherein the route of the gas up to the suction acoustic filter is substantially enhanced and the overheating levels are reduced. The improvement of the process of capturing the gas addresses in the configuration of the inlet shield 211, which is obtained by a cut of 45°.

Although it has been described an example of preferred concretization of the present invention, it shall be understood that the scope of the same includes other possible variations, being only limited by the content of the claims, in which are included the possible equivalent means.

The invention claimed is:

1. An acoustic filter suitable for reciprocating compressor comprising:

at least a superior body (2), at least an inferior body (3), at least an internal body (4), at least one inlet pipeline (21), at least one outlet pipeline (22), and at least one intermediate pipeline (42), CHARACTERIZED in that:

said acoustic filter (1) comprises at least two horizontal chambers (5, 6), wherein a first horizontal chamber (5) is disposed over a second horizontal chamber (6);

said horizontal chambers (5, 6) are delimited by the internal body (4);

said at least one inlet pipeline (21) protrudes from the superior body (2) connecting the exterior of said acoustic filter to the first horizontal chamber (5);

said at least one intermediate pipeline (42) is comprised by the internal body (4), wherein said intermediate pipeline (42) extends to both horizontal chambers (5, 6) from the internal body (4);

said at least one outlet pipeline (22) of the superior body connects the second horizontal chamber (6) to the compression chamber of the compressor; and said at least one intermediate pipeline (42) comprising a superior segment (421) which extends from the internal body (4) to the first horizontal chamber (5) with a length that is equivalent to approximately 75% to 98% of the height of the first horizontal chamber (5).

2. The acoustic filter of claim 1, CHARACTERIZED in that said at least one intermediate pipeline (42) comprises an inferior segment (422), which extends from the internal body (4) to the second horizontal chamber (6) with a length that is equivalent to approximately 45% to 80% of the height of the second horizontal chamber (6).

3. The acoustic filter of claim 1, CHARACTERIZED in that said inlet pipeline (21) has a fundamentally oblong perimeter.

4. The acoustic filter of claim 1, CHARACTERIZED in that said inlet pipeline (21) has a fundamentally circular perimeter.

5. The acoustic filter of claim 1, CHARACTERIZED in that said inlet pipeline (21) has at least one inlet shield (211) that is defined by an angled displacement ($\alpha$) between the vertical edge (21*b*) and a plane which orthogonally cuts the outlet pipeline (21).

6. The acoustic filter of claim 1, CHARACTERIZED in that the inlet pipeline (21) opening is disposed misaligned with the suction pipeline (TS).

* * * * *